US005308147A

United States Patent [19]

Tseng

[11] Patent Number: 5,308,147

[45] Date of Patent: May 3, 1994

[54] ASSEMBLY OF CHAIR FRAME AND REINFORCING ROD UNIT

[75] Inventor: Chuen-Jong Tseng, Chia-I-Hsien, Taiwan

[73] Assignee: Shin Yeh Enterprise Co., Ltd., Taiwan

[21] Appl. No.: 51,464

[22] Filed: Apr. 22, 1993

[51] Int. Cl.[5] ..... A47C 7/00

[52] U.S. Cl. ..... 297/452.18; 297/440.1; 297/440.20; 297/452.20; 248/351

[58] Field of Search ..... 297/440.1, 440.20, 452.16, 297/452.20; 248/351

[56] References Cited

U.S. PATENT DOCUMENTS 4,526,423 7/1985 Meinershagen et al. ..... 297/452.18
4,750,784 6/1988 Schwartz ..... 297/440.21

FOREIGN PATENT DOCUMENTS 923245 12/1954 Fed. Rep. of Germany ..... 248/351
635854 4/1950 United Kingdom ..... 248/351

*Primary Examiner*—Peter R. Brown
*Attorney, Agent, or Firm*—Ladas & Parry

[57] ABSTRACT

An assembly of a chair frame and a reinforcing rod unit is provided to prevent deformation of the chair frame. The chair frame is U-shaped and has two parallel longitudinal frame portions. The reinforcing rod unit has two ends coupled with the longitudinal frame portions respectively so as to prevent the longitudinal frame portions from deformation. The reinforcing rod unit includes a horizontal tube and two pivotal connector mechanisms respectively coupled with two ends of the tube. Each of the mechanisms includes an elongated tube connector coupled with the tube, a flexible hollow frame connector coupled with the corresponding longitudinal frame portion, and a pivot pin to mount the tube connector pivotally on the frame connector. In assembly, when the reinforcing rod unit is placed between the longitudinal frame portions of the chair frame, each of the frame connectors is located at an angular position, in which the ends of the reinforcing rod unit abut against the longitudinal frame portions of the chair frame. Then, the frame connectors are rotated relative to the tube connectors so as to push the longitudinal frame portions of the chair frame outward, thereby locating the reinforcing rod unit at a position in which the total length of the reinforcing rod unit is maximum.

3 Claims, 5 Drawing Sheets

ASSEMBLY OF CHAIR FRAME AND REINFORCING ROD UNIT

BACKGROUND OF THE INVENTION

1. Field of the Invention

This invention relates to an assembly of a chair frame and a reinforcing rod unit, more particularly to a reinforcing rod unit provided at two ends thereof with two pivotal connector mechanisms which are coupled with the chair frame so as to prevent effectively the deformation of the chair frame.

2. Description of the Related Art

Referring to FIG. 1, several straps (11) and a reinforcing rod (12) are provided on a chair frame (1) in a known manner. The chair frame (1) is U-shaped and has two parallel longitudinal frame portions. The straps (11) are stretched between the longitudinal frame portions. The reinforcing rod (12) has two L-shaped ends (12) respectively inserted into slots formed in the longitudinal frame portions of the chair frame (1) so as to prevent deformation of the longitudinal frame portions. However, the reinforcing rod (12) is too thin to prevent effectively the deformation of the longitudinal frame portions.

SUMMARY OF THE INVENTION

The main object of the invention is to provide an assembly of a chair frame and a reinforcing rod unit which can prevent effectively the deformation of the chair frame.

According to this invention, an assembly of a chair frame and a reinforcing rod unit is provided to prevent deformation of the chair frame. The chair frame is U-shaped and has two parallel longitudinal frame portions. The reinforcing rod unit is made of a rigid material and has two ends coupled with the longitudinal frame portions respectively so as to prevent deformation of the longitudinal frame portions. The reinforcing rod unit includes a horizontal tube and two pivotal connector mechanisms respectively coupled with two ends of the tube. Each of the pivotal connector mechanisms includes an elongated tube connector coupled with the tube, a flexible hollow frame connector coupled with the corresponding longitudinal frame portion, and a pivot pin for mounting the tube connector pivotally on the frame connector. In assembly, when the reinforcing rod unit is placed between the longitudinal frame portions of the chair frame, each of the frame connectors is located at an angular position, in which the ends of the reinforcing rod unit abut against the longitudinal frame portions of the chair frame. Then, the frame connectors are rotated relative to the tube connectors so as to push the longitudinal frame portions of the chair frame outward, thereby locating the reinforcing rod unit at a position in which the total length of the reinforcing rod unit is maximum.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 2:
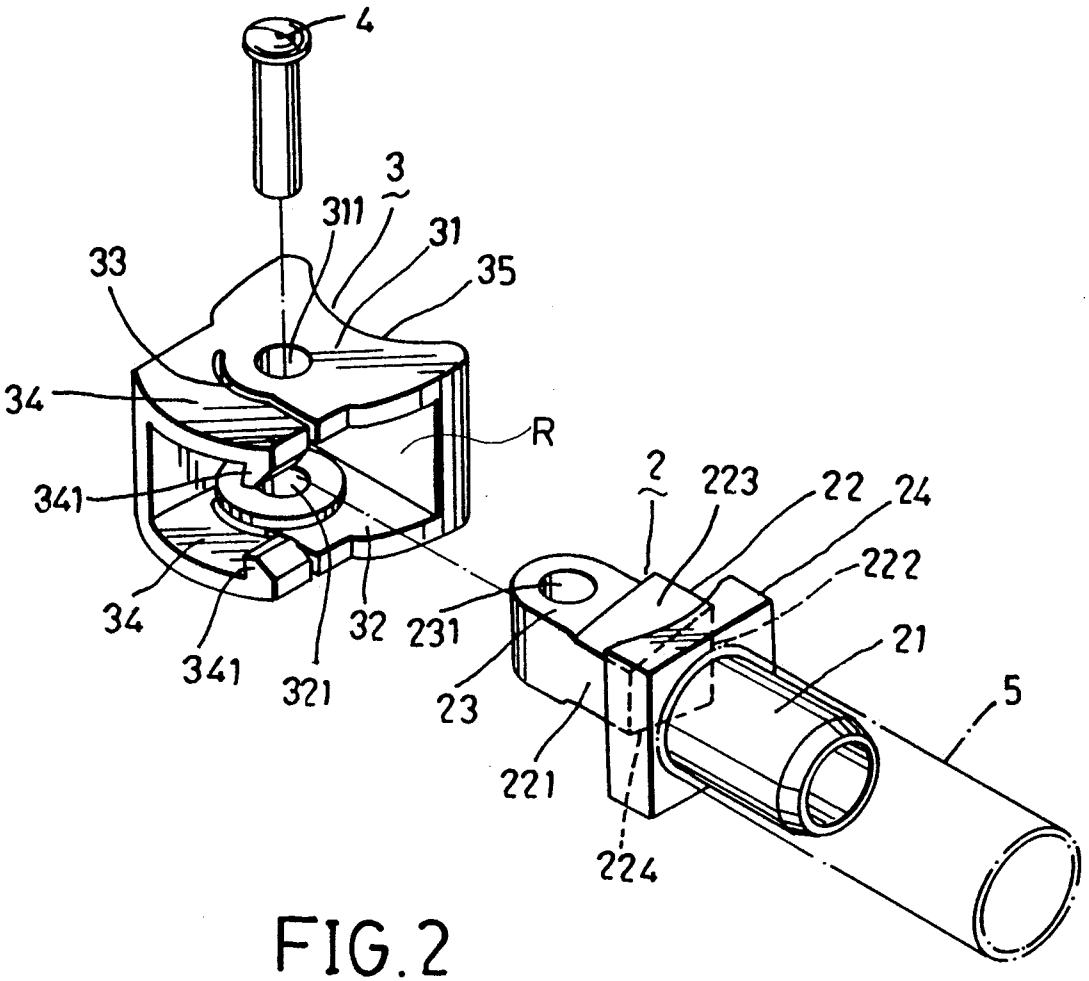
FIG. 2 is an exploded view showing one of the pivotal connector mechanisms of an assembly of a chair frame and a reinforcing rod unit according to this invention.
Figure 6:
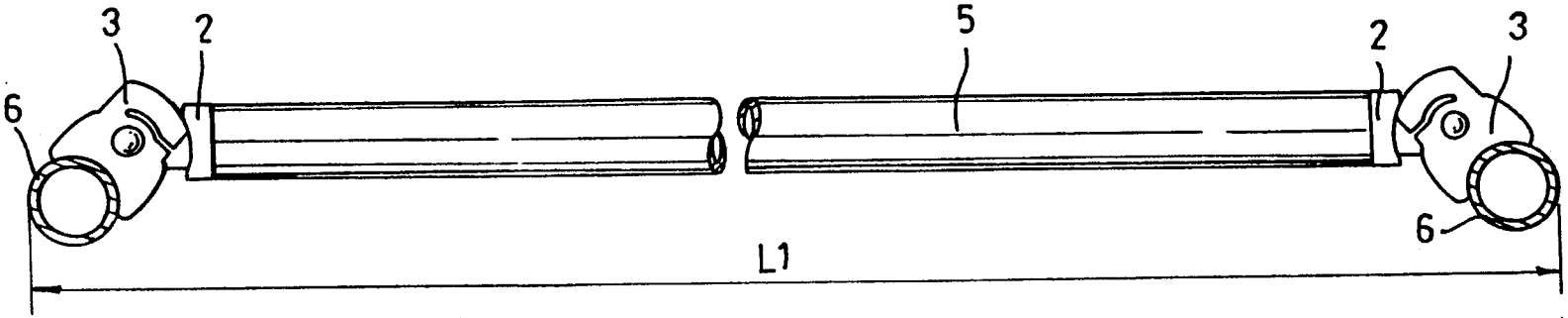
FIGS. 6 and 7 illustrate how the assembly of this invention is assembled.

Referring to FIGS. 2 and 6, in an assembly of a chair frame and a reinforcing rod unit of the first embodiment of this invention, the chair frame is U-shaped and has two parallel longitudinal frame portions (6) and a horizontal frame portion (not shown) interconnecting the longitudinal frame portions (6). The reinforcing rod unit is made of a rigid material and includes a horizontal tube (5) and two pivotal connector mechanisms respectively coupled with two ends of the tube (5). Each of the pivotal connector mechanisms includes an elongated tube connector (2) coupled with the end of the tube (5), a flexible hollow frame connector (3) coupled with the corresponding longitudinal frame portion (6) of the chair frame, and a pivot pin (4) for mounting the tube connector (2) pivotally on the frame connector (3).

Each of the tube connectors (2) includes an insert section (21), a tapered section (22), a pivot section (23), and a shoulder section (24). The insert section (21) is engaged within an end of the tube (5). The shoulder section (24) abuts against the end portion of the tube (5). The tapered section (22) is connected securely to an end of the shoulder section (24) and has a high side surface (222) with two aligned vertical sides, and a low side surface (221) with two aligned vertical sides that are smaller than the vertical sides of the high side surface (222), thereby forming an inclined upper surface (223) and a horizontal bottom surface (224). The pivot section (23) is connected securely to an end of the tapered section (22) and has a pivot hole (231) formed therethrough.

Each of the frame connectors (3) includes a horizontal top wall (31), a horizontal bottom wall (32), a curved vertical side wall (35) which interconnects the top and bottom walls (31, 32) and which abuts against the corresponding longitudinal frame portion (6), and a recess (R) formed in the frame connector (3) between the top and bottom walls (31, 32). Each of the top and bottom walls (31, 32) has an open-ended slot (33) which is formed therethrough so as to define a curved pawl plate portion (34) on one side of the slot (33) and a pivot hole (311, 321) which is formed on the other side of the slot (33) between the slot (33) and the curved side wall (35).

The pivot pin (4) extends through the pivot hole (231) of the tube connector (2) and the pivot holes (321) of the frame connector (3).

Figure 5:
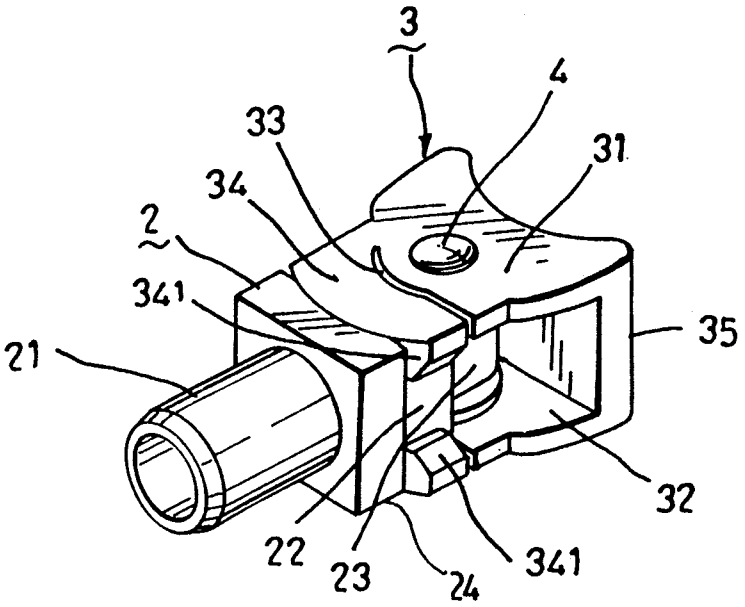
FIG. 5 is an assembled view showing the pivotal connector mechanism of the reinforcing rod unit of the present invention.
Figure 3:
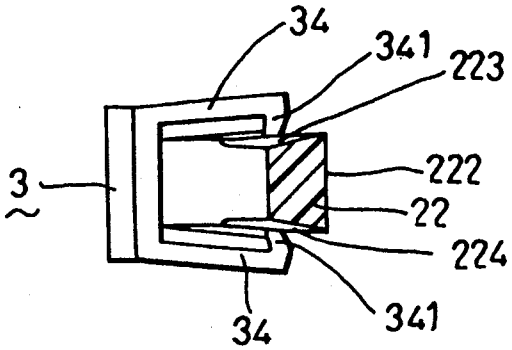
FIGS. 3 and 4 illustrate how the pivotal connector mechanism is operated in accordance with this invention.
Figure 4:
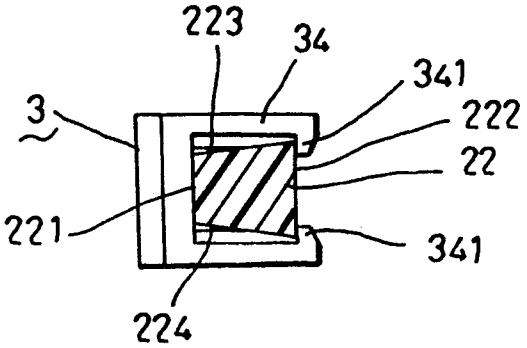

Referring to FIGS. 3, 4 and 5, each of the pawl plate portions (34) has a barb (341) projecting inward from an end portion thereof so as to define a restricted gap between the pawl plate portions (34), thereby confining the tapered section (22) of the corresponding tube connector (2) within the restricted gap in such manner that the high side surface (222) of the tapered section (22) abuts against the barb (341) (shown in FIG. 4). The barbs (341) are spaced apart from each other at a distance which is greater than the length of the vertical sides of the lower side surface (221) and which is smaller than the length of the vertical sides of the high side surface (222). As best shown in FIG. 5, the tapered section (22) of each of the tube connectors (2) has a curved side surface on which the curved pawl plate portion (34) abuts so as to enable sliding movement therebetween.

Referring to FIGS. 3 and 6, when the tapered section (22) of the tube connector (2) is not inserted entirely in the restricted gap, the chair frame has a width (L1).

Figure 1:
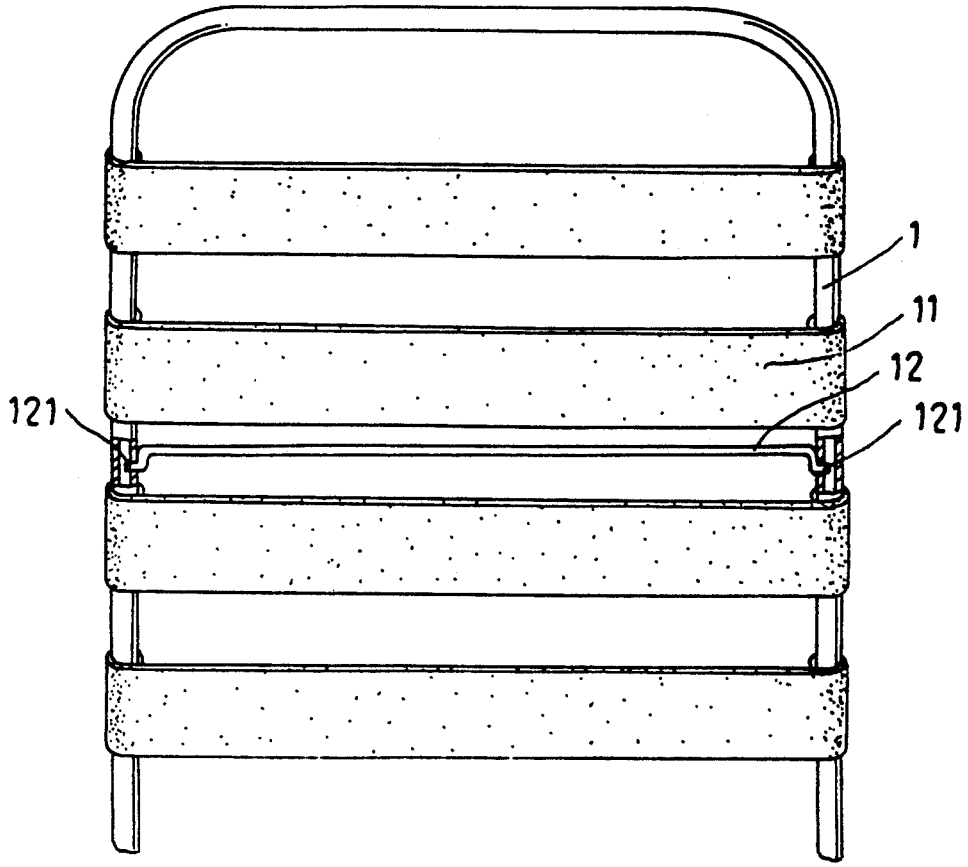
FIG. 1 PRIOR ART
FIG. 1 is a perspective view of a conventional assembly of a chair frame and a reinforcing rod unit.
Figure 7:
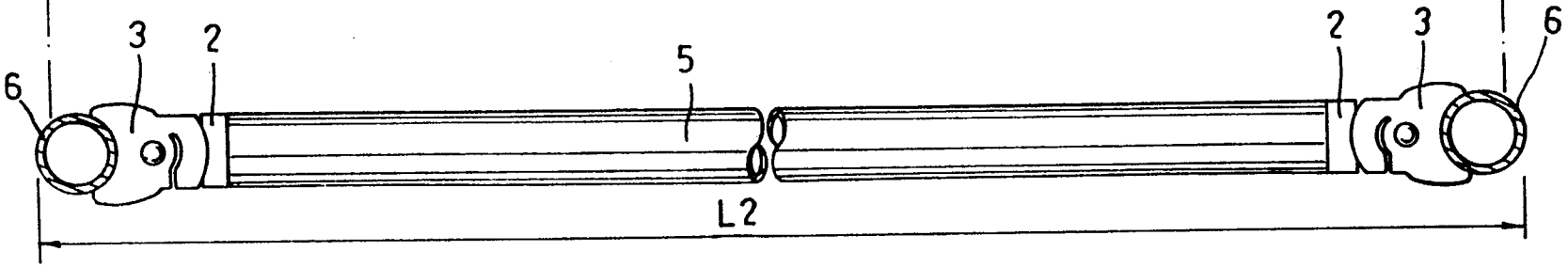

Referring to FIGS. 4 and 7, when relative rotation between the tube connectors (2) and the frame connectors (3) is effected so that the tapered section (22) of the tube connector (2) is confined in the restricted gap, thereby pushing the longitudinal frame portions (6) outward, the chair frame has a greatest width (L2) so as to prevent inward movement of the longitudinal frame portions (6) due to pulling action of the straps (11) (see FIG. 1).

Figure 8:
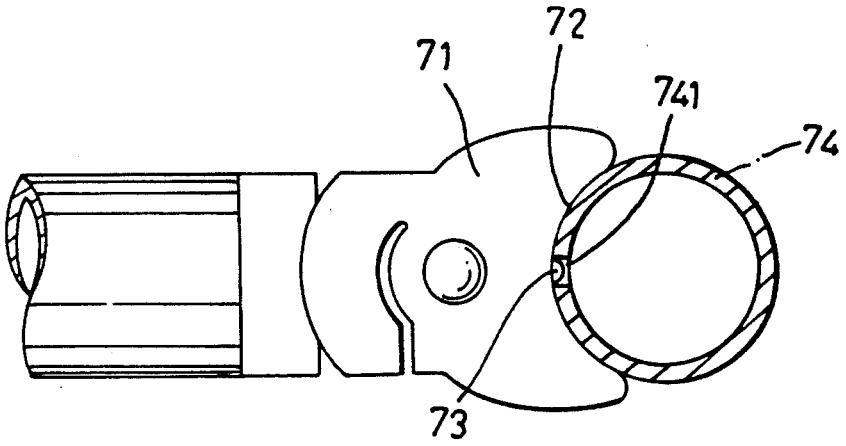
FIGS. 8 and 9 illustrate another two embodiments of this invention.

FIG. 8 illustrates an assembly of a chair frame and a reinforcing rod unit of the second embodiment of this invention. As illustrated, each of the longitudinal frame portions (74) has a positioning hole (741) formed therein. The curved side wall (72) of each of the frame connectors (71) includes a positioning projection (73) protruding therefrom to engage within the positioning hole (741) of the corresponding longitudinal frame portion (74) so as to position the frame connector (71) on the longitudinal frame portion (74).

Figure 9:
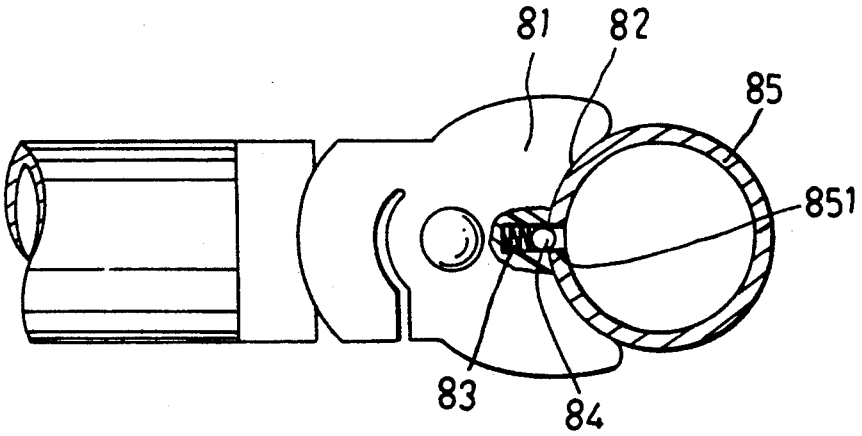

FIG. 9 illustrates an assembly of a chair frame and a reinforcing rod unit of the third embodiment of this invention. As illustrated, each of the longitudinal frame portions (85) has a positioning hole (851) formed therein. The curved side wall (82) of each of the frame connectors (81) includes a spring (83) mounted therein and a ball (84) biased by the spring (83) to engage within the positioning hole (851) of the corresponding longitudinal frame portion (85) so as to position the frame connector (81) on the longitudinal frame portion (85).

With this invention thus explained, it is apparent that numerous modifications and variations can be made without departing from the scope and spirit of this invention. It is therefore intended that this invention be limited only as indicated in the appended claims.

I claim:

1. An assembly of a chair frame and a reinforcing rod unit, said chair frame being U-shaped and having two parallel longitudinal frame portions, said reinforcing rod unit being made of a rigid material and having two ends coupled with said longitudinal frame portions respectively so as to prevent deformation of said longitudinal frame portions, wherein the improvement comprises said reinforcing rod unit including a horizontal tube and two pivotal connector mechanisms respectively coupled with two ends of said tube, each of said pivotal connector mechanisms including an elongated tube connector coupled with said tube, a flexible hollow frame connector coupled with a corresponding said longitudinal frame portion, and a pivot pin for mounting said tube connector pivotally on said frame connector, each of said tube connectors including an insert section engaged within an end portion of said tube, a shoulder section against which the end portion of said tube abuts, a tapered section connected securely to an end of said shoulder section and having a high side surface with two aligned vertical sides, and a low side surface with two aligned vertical sides smaller than said vertical sides of said high side surface, and a pivot section connected securely to an end of said tapered section, said pivot section having a pivot hole formed therethrough, each of said frame connectors including a horizontal top wall, a horizontal bottom wall, a curved vertical side wall interconnecting said top and bottom walls and being adapted to abut against the corresponding said longitudinal frame portion, and a recess formed in said frame connector between said top and bottom walls, each of said top and bottom walls having an open-ended slot formed therethrough and defining a pawl plate portion on one side of said slot, and a pivot hole formed on the other side of said slot between said slot and said curved side wall, said pivot pin extending through said pivot hole of said tube connector and said pivot holes of said frame connector, each of said pawl plate portions having a barb projecting inward from an end portion thereof so as to define a restricted gap between said pawl plate portions, thereby confining said tapered section of a corresponding said tube connector within said restricted gap in such a manner that said high side surface of said tapered section abuts against said barbs, said barbs being spaced apart from each other at a distance which is greater than a length of said vertical sides of said lower side surface and which is smaller than a length of said vertical sides of said high side surface.

2. An assembly as claimed in claim 1, wherein each of said longitudinal frame portions has a positioning hole formed therein, said curved side wall of each of said frame connectors including a positioning projection protruding therefrom to engage within said positioning hole of a corresponding said longitudinal frame portion so as to position said frame connector on said longitudinal frame portion.

3. An assembly as claimed in claim 1, wherein each of said longitudinal frame portions has a positioning hole formed therein, said curved side wall of each of said frame connectors including a spring-biased ball projecting therefrom to engage within said positioning hole of a corresponding said longitudinal frame portion so as to position said frame connector on said longitudinal frame portion.

* * * * *